US012551036B1

(12) United States Patent
Cohen

(10) Patent No.: US 12,551,036 B1
(45) Date of Patent: Feb. 17, 2026

(54) BED SKIRT SYSTEM FOR ADJUSTABLE BED

(71) Applicant: The Hospitality Solutions, LLC, Fort Lauderdale, FL (US)

(72) Inventor: Shirley Cohen, Fort Lauderdale, FL (US)

(73) Assignee: HOSPITALITY SOLUTIONS HOLDINGS, LLC, Fort Lauderdale, FL (US)

( * ) Notice: Subject to any disclaimer, the term of this patent is extended or adjusted under 35 U.S.C. 154(b) by 0 days.

(21) Appl. No.: 19/263,775

(22) Filed: Jul. 9, 2025

(51) Int. Cl.
*A47G 9/02* (2006.01)
*A47G 9/04* (2006.01)

(52) U.S. Cl.
CPC ..... *A47G 9/0292* (2013.01); *A47G 9/04* (2013.01)

(58) Field of Classification Search
CPC ..... A47G 9/02; A47G 9/0284; A47G 9/0292; A47G 9/04
See application file for complete search history.

(56) References Cited

U.S. PATENT DOCUMENTS 3,381,320 A * 5/1968 Lee ..... A47G 9/0284 5/482
5,621,931 A * 4/1997 Hamilton ..... A47G 9/0292 5/493
5,802,637 A * 9/1998 Bordo ..... A47G 9/0292 5/663
6,971,129 B2 * 12/2005 Wootten, Jr. ..... A47G 9/0292 5/493
7,984,522 B1 * 7/2011 Pfleger ..... A47G 9/0292 5/493
8,863,330 B2 * 10/2014 Cohen ..... A47G 9/0292 5/493
2002/0095727 A1 * 7/2002 Saparow ..... A47G 9/0284 5/482
2004/0237197 A1 * 12/2004 Cohen ..... A47G 9/0292 5/493
2009/0313795 A1 * 12/2009 Hardee ..... A47G 11/006 24/596.1
2011/0167561 A1 * 7/2011 Gatzke ..... A47G 9/0292 5/493

(Continued)

OTHER PUBLICATIONS

Wikipedia contributors. (2024, September 4). Godet (sewing). In Wikipedia, The Free Encyclopedia. Retrieved 20:18, Jun. 24, 2025, from https://en.wikipedia.org/w/index.php?title=Godet_(sewing)&oldid=1243966103.

*Primary Examiner* — George Sun
(74) *Attorney, Agent, or Firm* — Fleit Intellectual Property Law; Jon Gibbons

(57) ABSTRACT

A system for securing a bed skirt to an adjustable bed frame with a right side, a left side, a head area, and a foot area, with a first hinge disposed at a first distance from the head of the adjustable bed frame and a second hinge disposed at a second distance from the head of the adjustable bed frame to allow independent adjustment of various sections of lying surface. The bed skirt for an adjustable bed includes two side panels and a front panel. The front panel may include two corner foot flaps located at opposing ends of the front panel. The front panel, two side panels, and two corner foot flaps are capable of being interconnected and interlocked at their respective perimeters by hook and loop fasteners.

14 Claims, 11 Drawing Sheets

(56) References Cited

U.S. PATENT DOCUMENTS

| | | | | |
|---|---|---|---|---|
| 2012/0042450 | A1* | 2/2012 | Hamilton | A47G 9/0292 5/493 |
| 2012/0060281 | A1* | 3/2012 | Mitchell | A47G 9/0292 5/493 |
| 2012/0204348 | A1* | 8/2012 | Bayer | A47G 9/08 5/413 R |
| 2014/0000029 | A1* | 1/2014 | Masoncup | A47G 9/0292 112/475.08 |
| 2014/0359948 | A1* | 12/2014 | Middlesworth | A47C 31/007 5/690 |
| 2015/0013067 | A1* | 1/2015 | Coughlin | A47G 9/0292 5/493 |
| 2016/0242559 | A1* | 8/2016 | Hui | A47G 9/0246 |
| 2018/0177313 | A1* | 6/2018 | Cohen | A47G 9/04 |
| 2019/0099020 | A1* | 4/2019 | Stewart | A47G 9/04 |
| 2019/0282005 | A1* | 9/2019 | Alletto, Jr. | A47G 9/04 |

* cited by examiner

BED SKIRT SYSTEM FOR ADJUSTABLE BED

FIELD OF THE DISCLOSURE

The present disclosure generally relates to a system and method for securing a bed skirt to a box spring and, more particularly, for securing a bed skirt to an adjustable bed frame.

BACKGROUND

The popularity of adjustable beds continues to grow in residential homes, hotels, and the hospitality industry. Uses of adjustable beds enjoy repositing portions with a simple push of a button. Adjustable beds include multi-hinged lying surfaces that can be profiled to a number of different positions using drive motors. Common adjustments include inclining the upper body and raising the lower body independently of each other.

Bed skirts present several challenges when used with movable or adjustable beds. One major issue is the potential for interference with the bed's mechanisms. The fabric of the bed skirt can get caught in the moving parts, leading to operational difficulties or even damage. Additionally, the bed skirt can restrict the bed's ability to adjust freely, compromising its functionality. Maintenance also becomes problematic, as bed skirts may require constant readjustment due to shifting positions, leading to a messy appearance. Moreover, bed skirts can affect the aesthetics, airflow, and safety of movable beds.

Bed skirts available today for moveable beds typically include elastic around the top edge to give it the flexibility needed to move with the frame. However, the bed skirt needs to be readjusted every time the bed frame position changes and returns to the flat position. It also can be a hazard. It also affects the aesthetics.

Movable beds often feature a sleek design, and a traditional bed skirt may detract from this modern look. The option for most to hide the 'legs' of the movable bed frame is to buy a new headboard with a decorative built-in frame to conceal the movable bed frame and its legs. Purchasing a new headboard usually requires changing the complete set of bedroom furnishings, which is expensive and wasteful.

Further, Bed skirts can impede airflow under the bed, making it harder to clean or maintain the bed's base. They can also pose safety risks, such as tripping or entanglement hazards, especially with loose fabric near the bed's moving parts. Furthermore, bed skirts available today generally do not move with adjustable beds.

SUMMARY

The following presents a simplified summary of the invention in order to provide a basic understanding of some aspects of the invention. This summary is not an extensive overview of the invention. Rather than specifically identifying key or critical elements of the invention or delineating the scope of the invention, its purpose, inter alia, is to present some concepts of the invention in a simplified form as a prelude to the more detailed description that is presented later.

Example 1—Standard Bed Skirt with Gusset Pleats

A bed skirt for a bed includes a set of three rectangular sections—namely, a first, second, and third section—each defined by a top and bottom portion, an inner and outer side, and two ends. Triangular-shaped gusset pleat inserts are positioned between adjacent rectangular sections. A first gusset pleat, made from a fabric with a first grain, is sewn between the second end of the first rectangular section and the first end of the second rectangular section. The seams connecting this gusset are oriented substantially perpendicular to the top portion of the skirt, with one seam running across the grain and another along the grain. A second gusset pleat, made from a different fabric with a second grain, connects the second end of the second rectangular section to the first end of the third rectangular section, again using seams oriented similarly but with grains reversed. A strip of hook or loop fastener is attached along the top portion of the inner side of the skirt panels for easy attachment to a bed frame.

The gusset pleat inserts are designed not only to connect panels but also to allow the skirt to form a substantially U-shaped or parabolic curve around the bed. Each gusset pleat may include a single fold or multiple folds between the gusset's first and second edges. These folds protrude from the outer side toward the inner side, enhancing both visual appeal and the skirt's ability to flex when the bed is made or when weight is applied.

The bed skirt may also be part of a system that includes a bed frame with a right side, left side, head area, and foot area. A corresponding strip of hook or loop fastener is affixed to one or both side top portions of the bed frame. This matching fastener allows the bed skirt panels to be quickly and securely attached to the frame without draping under the mattress.

Example 2—Adjustable Bed Skirt with Hinged Compatibility

For adjustable bed frames with one or more hinges between head, middle, and foot sections, the bed skirt system includes a pair of U-shaped side skirt panels. Each panel consists of three rectangular portions joined by gusset pleat inserts. The gussets are strategically located at distances from the head area that correspond to the hinge locations of the bed frame. Each gusset is formed from triangular fabric pieces with seams oriented across and along the fabric grain to allow movement. A fastening strip runs along the top inner edge of each panel to secure the skirt to the adjustable frame. This configuration ensures the skirt flexes naturally with the motion of the bed's hinges.

Example 3—Integrated Folding Design from Single Fabric Panel

In another version, the skirt is constructed by cutting a trapezium-shaped piece from a rectangular fabric panel, which is then rotated 180 degrees and sewn between three rectangular portions to form head, middle, and foot sections. This shaping enables the skirt to accommodate the curve of an adjustable bed frame. Seams and triangular hems are used to maintain structural integrity and aesthetic flow, and additional folds may be included along the seams to provide flexibility and accommodate movement.

This embodiment features a fastening strip applied along the top of each rectangular skirt section—head, middle, and foot—to allow modular attachment to a variety of bed frame configurations. The fastening system may be mirrored on the bed frame, enabling quick setup and removal while ensuring the skirt stays in place during bed adjustment or cleaning.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
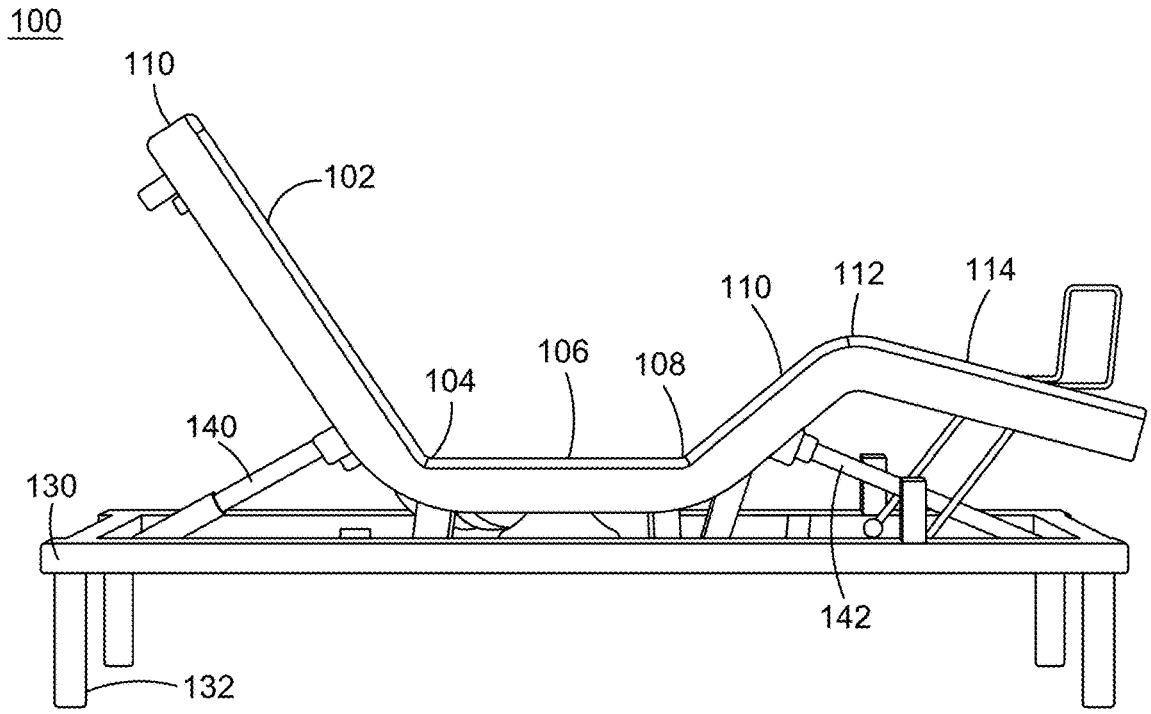
(Prior Art) FIG. 1
FIG. 1 is an adjustable bed frame with sections of the adjustable bed frame in different positions, according to the prior art.

The foregoing summary, as well as the following detailed description of certain embodiments of the subject matter set forth herein, will be better understood when read in conjunction with the appended drawings. In the following detailed description, reference is made to the accompanying drawings which form a part hereof, and in which are shown by way of illustration-specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized and that variations may be made without departing from the scope of the subject matter disclosed herein. The following detailed description is, therefore, not to be taken in a limiting sense, and the scope of the subject matter disclosed herein is defined by the appended claims and their equivalents.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting but merely as a basis for the claims and as a representative basis for teaching one skilled in the art to variously employ the disclosed subject matter in virtually any appropriately detailed structure and function. Further, the terms and phrases used herein are not intended to be limiting but rather to provide an understandable description.

Non-Limiting Definitions

The terms "a" or "an", as used herein, are defined as one or more than one. The term plurality, as used herein, is defined as two or more than two.

The term "adapted to" describes the hardware, software, or a combination of hardware and software that is capable of, able to accommodate, to make, or that is suitable to carry out a given function.

The term "adjustable bed" or "movable bed" is a bed base that has a multi-hinged lying surface that can be profiled to a number of different positions. Drive motors may be used to change the positions of the multi-hinged lying surface's various sections by simply pushing a button. Common adjustments include inclining the upper body and raising the lower body independently of each other. Other common features include height adjustment and tilting the bed to raise the upper body or the lower body into the Trendelenburg or reverse Trendelenburg positions.

The term "another", as used herein, is defined as at least a second or more.

The term "bed skirt" or "bed skirt" or also known as a "dust ruffle" is a piece of decorative fabric that is placed between the mattress and the bed frame of a bed that extends to the floor around the sides to provide a tailored loo. In addition to its aesthetics, a bed skirt is used to hide the ensemble fabric, bed frame, optional wheels and other unsightly objects underneath the bed or as protection against dust.

The term "configured to" describes hardware or a combination of hardware that is adapted to, set up, arranged, built, composed, constructed, designed, or that has any combination of these characteristics to carry out a given function.

The term "coupled," as used herein, is defined as "connected," although not necessarily directly, and not necessarily mechanically.

The term "godet" is an extra piece of fabric in the shape of a circular sector that is set into a garment. The addition of a godet causes the garment to flare, thus adding width and volume. A godet is usually triangular in shape, but it can also be in other shapes, like a wedge or a circular segment. The wide end of the triangle is inserted at the hemline, while the pointed end extends upward along the seam. It is typically sewn into the vertical seams of a skirt or dress, usually starting below the waistline or hip and extending to the hem. The godet is cut separately and inserted into a seam by opening it up, resulting in a flared effect where the seams separate at the hem. The construction is focused on flare and volume.

A godet is inserted into a seam or slit to add flare or volume to a garment. It is commonly used in skirts, dresses, or sleeves to create a more dramatic, flared shape. The godet is primarily decorative, used to add fullness and a flowing effect to a garment. Unlike a gusset, it's not about reinforcing or adding ease for movement but rather about enhancing the visual appeal and shaping of the garment. A godet adds volume, flare, and aesthetic appeal.

A "gusset" is typically a piece of fabric inserted into a seam to add breadth or reduce stress from tight-fitting garments. The difference between a gusset and a godet lies in their shape, purpose, and how they are used in a garment or fabric construction. A gusset is typically triangular or diamond-shaped but can also be a square depending on the area it is used.

The purpose of gussets is to be inserted into seams to provide extra room, flexibility, or reinforcement, particularly in areas that experience a lot of stress or require more ease of movement, such as a fitted skirt for walking, the underarm area in a sleeve or the crotch of pants. The main function of a gusset is to add strength and reduce strain on the garment, ensuring comfort, ease of movement, and durability. It's often used in functional garments like sportswear, workwear, or any clothing requiring additional movement. A gusset adds functionality, flexibility, and reinforcement. It is a functional rather than decorative addition.

Construction: The gusset is sewn into a seam intersection, expanding the garment at that point. It does not create flare or fullness but instead increases mobility and ease of movement without losing the visual appeal and shaping of the garment.

Placement: Typically inserted into the junction of seams (e.g., underarms, crotch of pants, or side seams of tight-fitting garments). It does not run to the hem but rather is concentrated in areas needing flexibility or additional space.

Directional Gusset Pleating is a technique emphasizing the controlled direction of the pleat created by the bias edge of the gusset. Different types of gussets include a Bias-Fold Gusset, which describes how the gusset is intended to fold along the bias edge, affecting the way it lays within the garment or fabric construction. Another type of gusset is an asymmetric Gusset Insertion, in which the deliberate asymmetry in how the gusset is positioned and how it influences the fabric's behavior. These unofficial terms could be used descriptively to communicate the technique in design discussions or pattern instructions. In technical design and patternmaking, such nuanced techniques might be explained rather than named. The terms "including" and "having," as used herein, are defined as comprising (i.e., open language).

The "grain of fabric" is the direction of the threads that are woven together to create the fabric. Fabric is usually made by weaving two or more threads together at right angles, and the grain refers to the direction of those threads. There are three types of grain in fabric:

i. Lengthwise grain: Also called warp or straight grain, this is the direction of the long threads that run parallel to the selvage of the fabric,
ii. Crosswise grain: Also called weft, this is the direction of the short threads that run perpendicular to the selvage, from selvage to selvage, and
iii. Bias grain: This is at a 45° angle to the selvage.

The terms "looped", "textured", "pile", or "bouclé" surface are fabrics that have properties that allow Velcro® hooks to attach. Examples include knit fabrics with a textured surface, such as a jersey knit, rib knit, or interlock knit. Another example is fleece fabrics with a pile surface. Another example is Terry cloth, which is often used with towels. Velour or velvet is another example of a short pile that can sometimes catch Velcro hooks, though not as strongly as knit or fleece.

The term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

The term "sewing on the grain" refers to sewing along the fabric's straight grain, which runs parallel to the selvage (the tightly woven edge that prevents the fabric from unraveling). It provides stability to the fabric. It retains its shape well, with minimal stretching or distortion. Application of sewing on the grain includes seams, hems, and structural parts of a garment or item where stability is key, such as waistbands, collars, and cuffs. Sewing on the grain generally offers more durability due to the fabric's inherent stability. Sewing on the bias, while more flexible, may require careful handling to prevent overstretching or warping.

The term "sewing on the bias" or "sewing at an angle" refers to sewing at a 45-degree angle to the straight grain, which is known as sewing on the bias. Fabric cut and sewn on the bias has more stretch and flexibility. This can create a more fluid, draped effect and allow the fabric to conform to curves more easily. Application of sewing on the bias includes bias-cut dresses, scarves, and other items where a softer, flowing appearance is desired. Sewing on the bias is also used in making piping and binding where flexibility is needed. The choice between sewing on the grain and at an angle affects the appearance and behavior of the fabric, influencing the overall aesthetic and functionality of the final product.

It should be understood that the steps of the methods set forth herein are not necessarily required to be performed in the order described, and the order of the steps of such methods should be understood to be merely exemplary. Likewise, additional steps may be included in such methods, and certain steps may be omitted or combined in methods consistent with various embodiments of the present device.

Incorporated References By Same Inventor

This application is related to U.S. Pat. No. 8,863,330, entitled "System and Method for Securing a Bed Skirt to A Box Spring" and U.S. Patent Application 2018/0177313 entitled "Interlock Three-Piece Bed Skirt System and Method", both of which are assigned to the same assignee as this application and the teachings of both which are herein incorporated by reference in its entirety. These incorporated references are also listed on the information disclosure statement submitted herewith. The patented track system is easily secured to the frame with small plastic t-tacks without damage to the fabric, is removeable and not visible during normal use.

Overview

The advantages of the bed skirts in the claimed invention work well for movable beds, such as adjustable or mechanical beds, for a variety of reasons. The first reason the present invention works well with adjustable beds is that it avoids interference with moving mechanisms. The bed skirt system of a movable bed does not hinder the movable bed's smooth operation. The claimed invention does not hinder or restrict the adjustable bed's ability to raise or lower, compromising the bed's functionality.

Movable beds are often designed with a modern and sleek appearance. The claim invention provides a bed skirt system for an adjustable bed that does not clash with the bed's aesthetic and gives a clean and contemporary look. The claimed invention avoids the requirement of frequent adjustments to bed skirts due to the adjustable bed's changing positions. The bed skirt system of the present invention does not shift, wrinkle, or bunch up, leading to a messy and untidy appearance. The bed skirt system does not block airflow under the bed, affecting ventilation and making it challenging to access the base of the movable bed for cleaning or maintenance purposes.

Moveable Bed

Now, we turn to FIG. 1, which is an example of a commercially available adjustable bed frame 100. In this example, there are four sections 102, 106, 110, 114 joined by hinges 104, 108, 112. The four sections 102, 106, 110, 114 are mechanically coupled to a base frame 130, and are typically supported by legs 132, as shown. The base frame uses one or more electric motor-driven positioners 140 and 142 to move the four sections 102, 106, 110, 114 into various positions in response to a user pushing one or more buttons.

Figure 2:
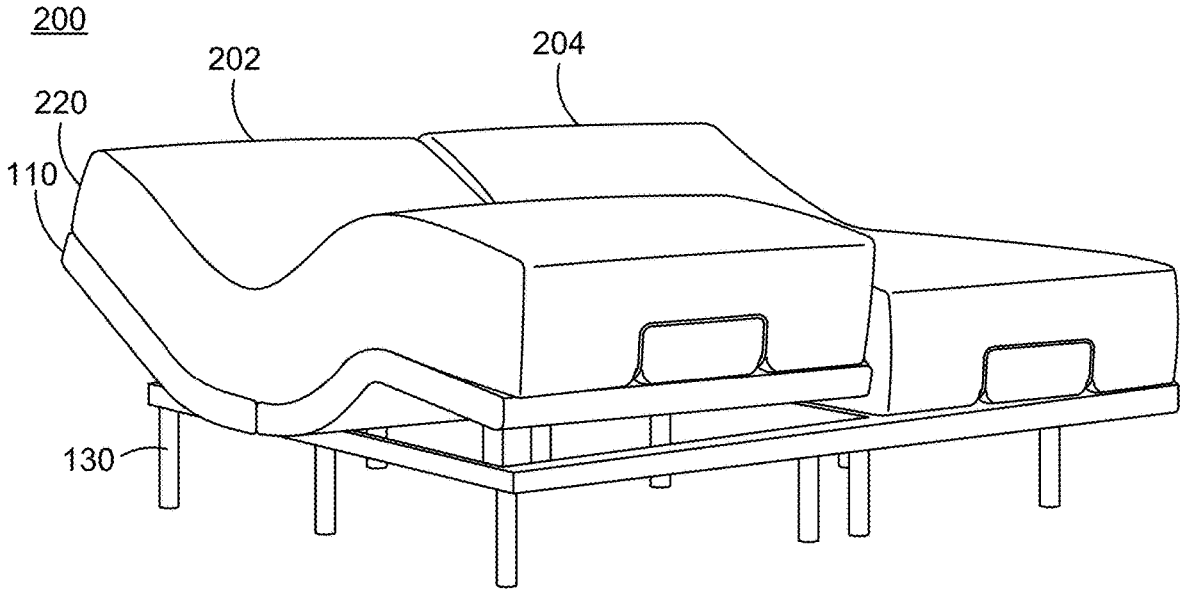
(Prior Art) FIG. 2
FIG. 2 is an adjustable bed frame for a twin or queen-size mattress with two independent adjustable sides with sections of the adjustable bed frame in different positions, according to the prior art.

FIG. 2 is a commercially available adjustable bed frame 200 for a queen or king-size mattress 220 with two independent adjustable sides 202, 204 with sections of the adjustable bed frame in different positions.

When selecting a bed frame, different configurations and bedding requirements apply depending on the size and type of frame. Twin and queen size frames are both single, movable frames. While queen size frames may come in two pieces, they still function as a single unit.

King size frames offer two primary options. The first option is a single king mattress with a two-part frame that operates as one unit. The second option involves two twin size mattresses on independent, movable frames, allowing each side of the bed to move separately.

For the dual mattress king configuration, two twin fitted sheets are required. However, the top sheet, blanket, and coverlet usually remain a single king size piece. The foot skirt panels also need to accommodate separate movement. Instead of a traditional single foot skirt, this setup uses two separate panels—a left and a right foot skirt panel—ensuring each frame can move independently without interference.

Choosing the appropriate frame and bedding configuration helps achieve comfort and functionality for your sleeping environment.

Further frame sizes may come in standard lengths and extra-long lengths.

Although the present invention is design for moveable beds, the inventor has discovered that claimed invention works well with a standard box spring as well using the patent strips disclosed in commonly owned incorporated patent references listed above.

Bed Skirt System

Figure 3:
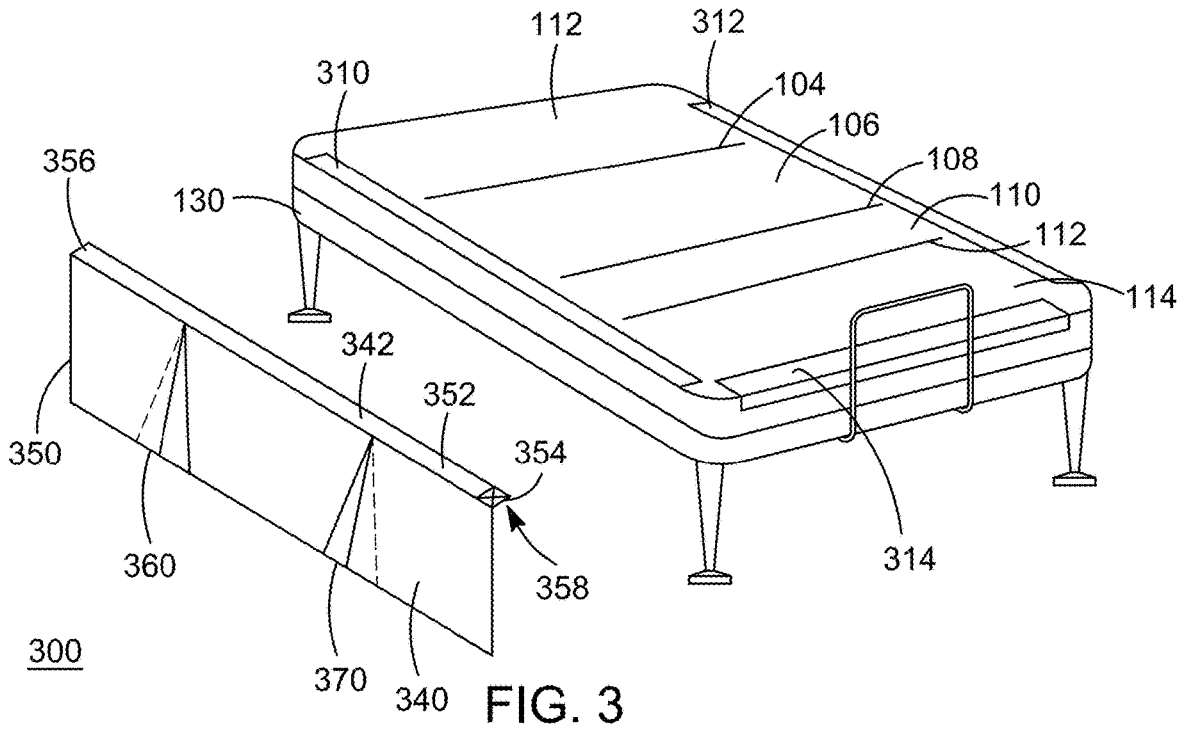
FIG. 3 is an adjustable bed of FIG. 1 with sections of the adjustable bed frame in a flat position, with a side panel of a bed skirt system according to one aspect of the present invention.

FIG. 3 is an adjustable bed 300 of FIG. 1 with sections of the frame 110 of the adjustable bed 100 in a flat position, with a side panel 350 of the bed skirt system illustrating an outer surface 340. The bed skirt system includes a hook and loop system 352 disposed on an inner surface 358 along the top portion 342 from corner 354 to corner 356 as shown. The hook and loop system 352 of side panel 350 securely fastens to top area 310 of frame 110. A second side panel (not shown) attaches to area 312 of frame 110. A front panel (such as in FIG. 11) is attached to area 314. Depending on the type of surface of top areas 310 and 312, the hook and loop system may attach directly to certain fabrics, such as looped, textured, pile, or boucle. In another example, a corresponding hook system is attached to top areas 310, 312, 314, such as those disclosed in commonly owned incorporated patent references listed above.

Figure 4:
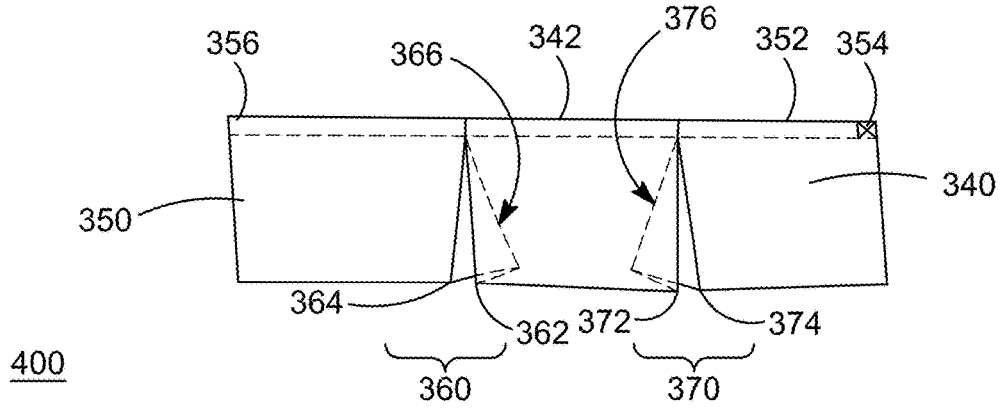
FIG. 4 depicts a view of the outer surface of the side panel of a bed skirt system, which is securable to a top outer edge of a frame of an adjustable bed, according to one aspect of the present invention.
Figure 5:
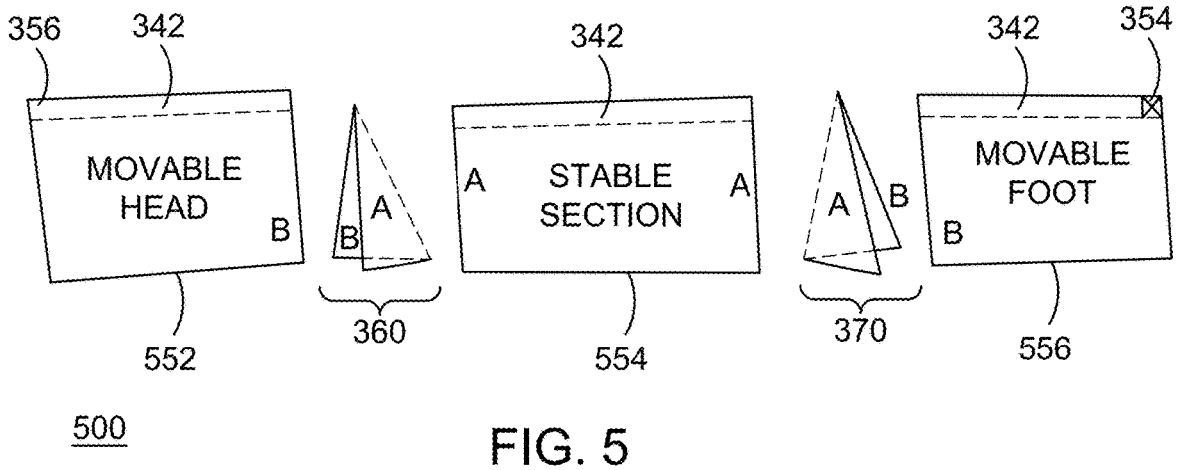
FIG. 5 depicts the side panel of FIG. 4 with five major portions, according to one aspect of the present invention.

First Embodiment—Inserts with Two Seams and a Single Fold Disposed in a Mirrored Position FIG. 4 depicts a view of the outer surface 340 of a side panel 350 of a bed skirt system, which is securable to a frame 110 of an adjustable bed 100. There are two gusset inserts 360 and 370. In this example, notice that the two gusset inserts 360 and 370 are disposed in a mirrored orientation along the side panel 350. The gusset inserts 360 and 370, each with one side on the grain and the other on the bias, creating a pleat that directs towards the bias edge, folding away from the seam. More specifically, gusset insert 360 includes one side forming a first seam 362 on the grain of the fabric and the other side forming a second seam 364 on the bias of the fabric. This creates a folded pleat 366 that directs towards the first seam 362 towards the stable section 554, as shown in FIG. 5.

Likewise, Gusset insert 370 includes one side forming a first seam 372 on the grain of the fabric and the other side forming a second seam 374 on the bias of the fabric. This creates a folded pleat 376 that directs towards the first seam 372 away from the stable section 554.

The folded pleats 366, 376 of the gusset inserts 360 and 370 away from a stable section 554, away from each other, when the bed returns to a flat position. The straight of the grain can also be the center of the triangle at the fold. The direction of the grain on the gusset may change depending on the fabric and weave. This can be described as a gusset inserted with one side on the grain and the other on the bias, creating a pleat that directs towards the bias edge, folding away from the seam. Stated differently, this is towards the stable section 554 or away from the stable section 554.

Generally, cutting a triangular gusset piece with one side on the grain and the other on the bias and inserting it between two panels cut on the grain uses the gusset to introduce flexibility and shape while maintaining stability where needed. The grain and bias orientation in the gusset will affect how it performs: The side cut on the grain will provide stability and maintain the structure of the seam. The side cut on the bias offers some stretch, allowing for movement and reducing stress on the seams.

FIG. 5 depicts the side panel 500 of FIG. 4 with five major portions. The five major portions are i) movable head 552, ii) gusset insert 360, iii) stable portion 554, iv) gusset insert 370, and v) movable foot 556. In one example, the side panel 350 may be constructed at different heights or hem length drop to accommodate different lengths of legs 132 of the adjustable bed 100. The length of the overall side panel is about 80 inches. The approximate length of the five major portions in one example is 26 inches for the movable head 552, 23 inches for the stable portion 554, and 31 inches for the movable foot 556. Of course, other lengths are possible and within the true scope and spirit of the present invention. Notations A and B are used to denote which sides are fastened to each of the two gusset inserts, 360 and 370.

Figure 6:
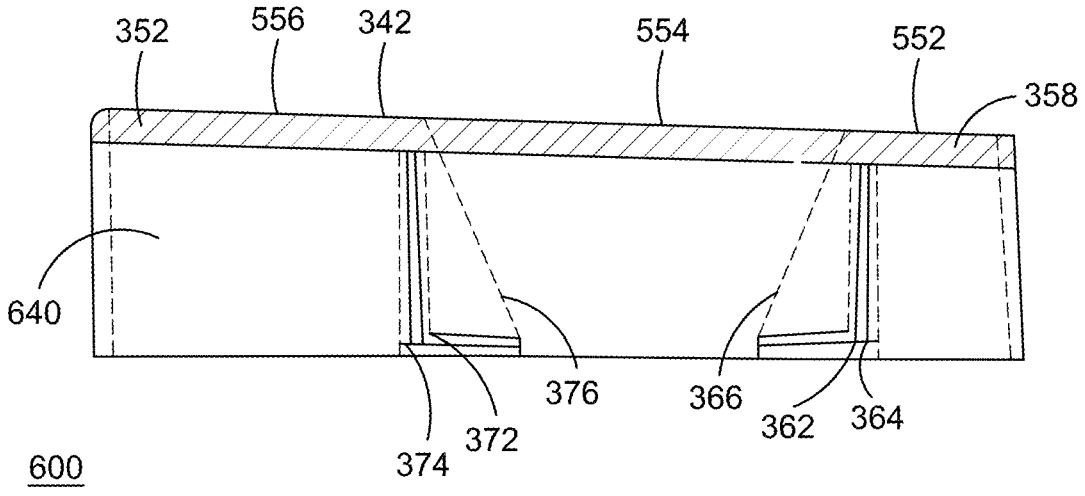
FIG. 6 depicts an inner surface of the side panel of the bed skirt system of FIG. 4, according to one aspect of the present invention.

FIG. 6 depicts an inner surface 358 of a side panel 350 of a bed skirt system of FIG. 4. Illustrated is the hook and loop system 352 on the inner surface 358 near the top 342.

Figure 7:
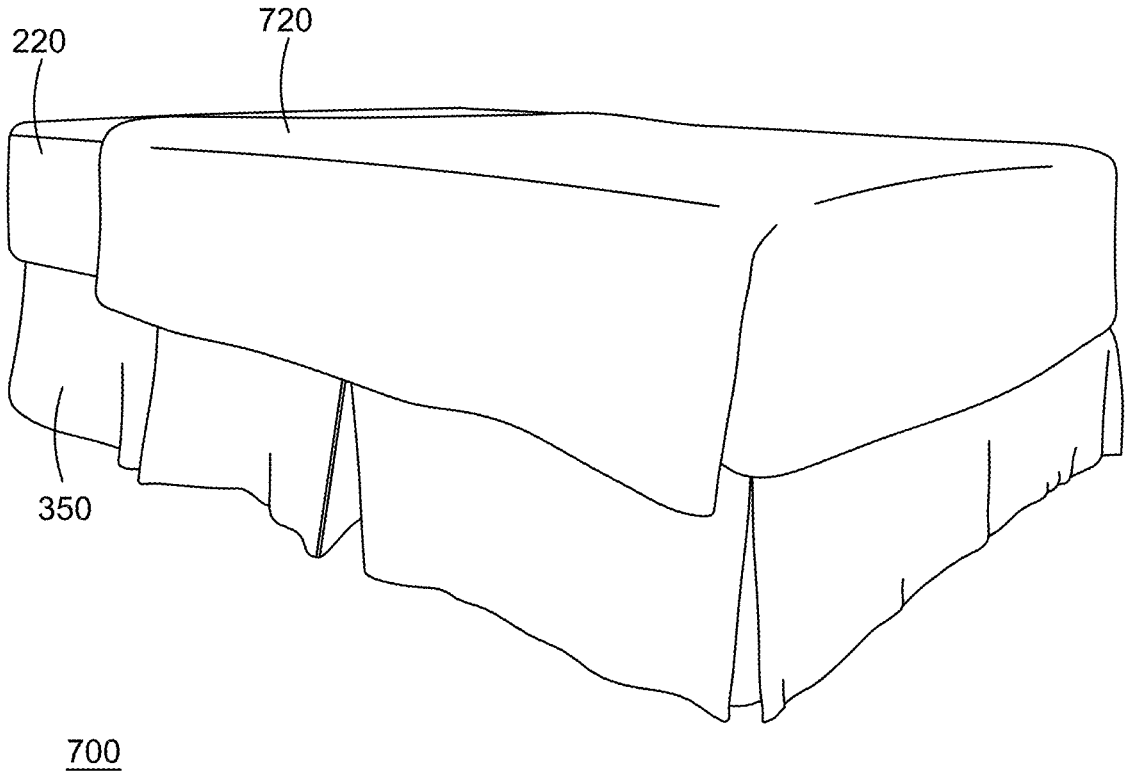
FIG. 7 depicts the side panel of the bed skirt system of FIG. 4 on an adjustable bed frame with sections in a flat position with a mattress and bed sheet, according to one aspect of the present invention.

FIG. 7 depicts the side panel 350 of the bed skirt system of FIG. 4 on an adjustable bed frame with sections in a flat position with a mattress 220 and bed sheet 720.

Figure 8:
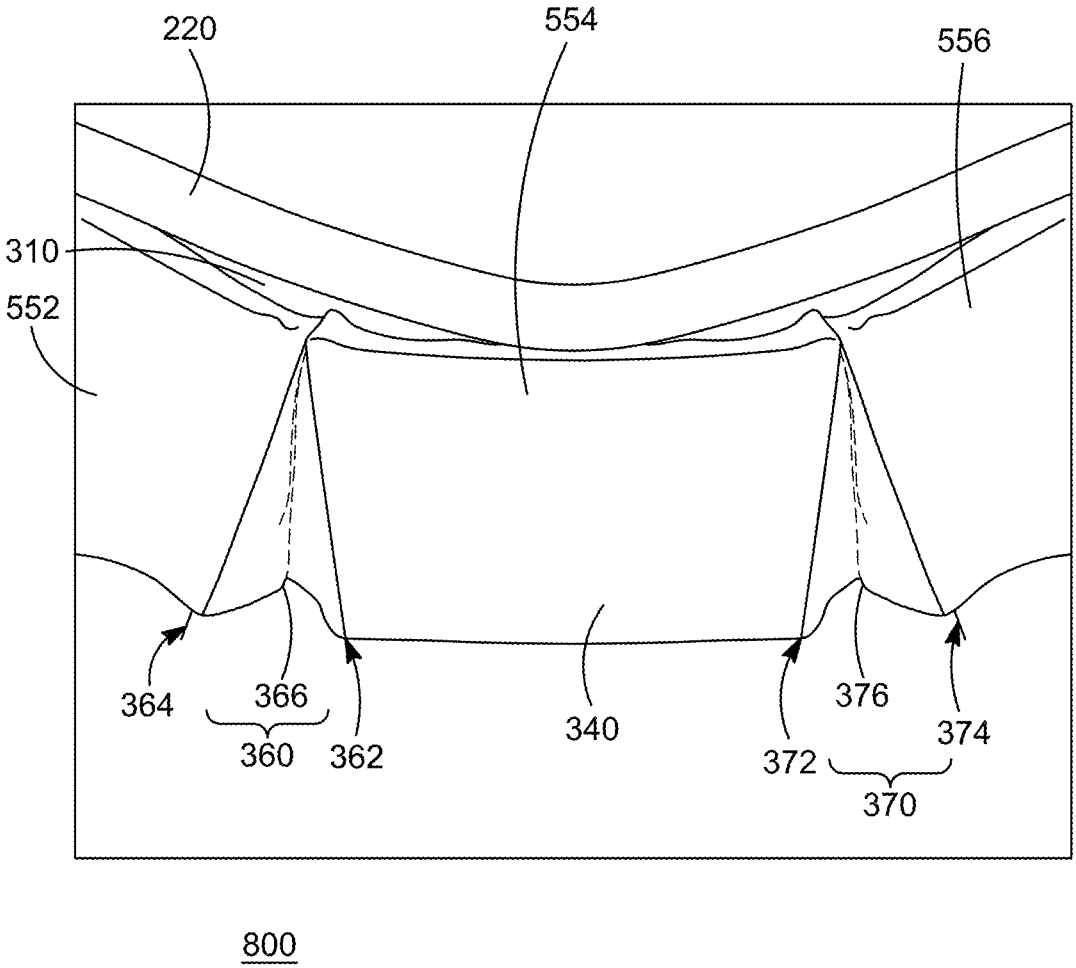
FIG. 8 depicts the side panel of the bed skirt system of FIG. 7 on an adjustable bed with a mattress on an adjustable bed frame in different positions, according to one aspect of the present invention.

FIG. 8 depicts the side panel 350, a bed skirt system in FIG. 7 on an adjustable bed with a mattress and bed sheet on an adjustable bed frame in different positions with the gusset inserts 360 and 374 in an expanded position compared with FIG. 7.

Figure 9:
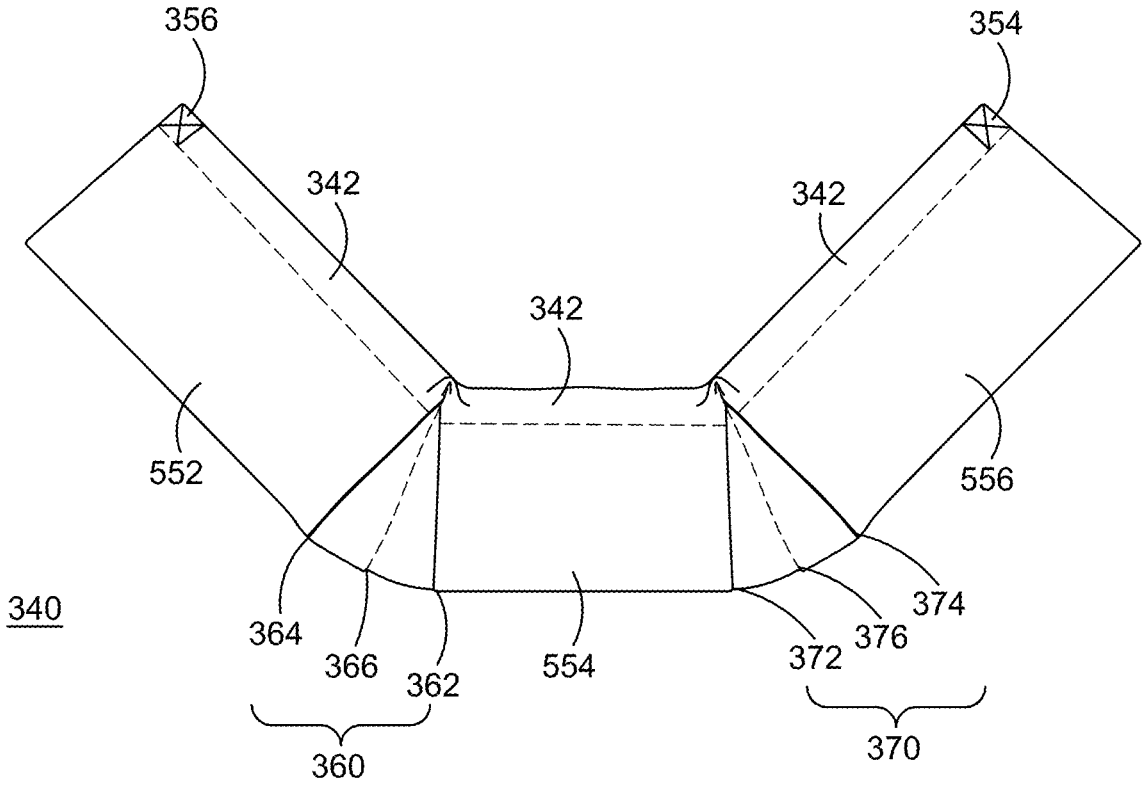
FIG. 9 depicts the outer surface of the side panel of the bed skirt system of FIG. 4 depicts details of the gusset, the fabric grain, and seams, according to one aspect of the present invention.

FIG. 9 depicts the outer surface of the side panel of a bed skirt system of FIG. 4 depicts details of the gusset, the fabric grain, and seams.

Figure 10:
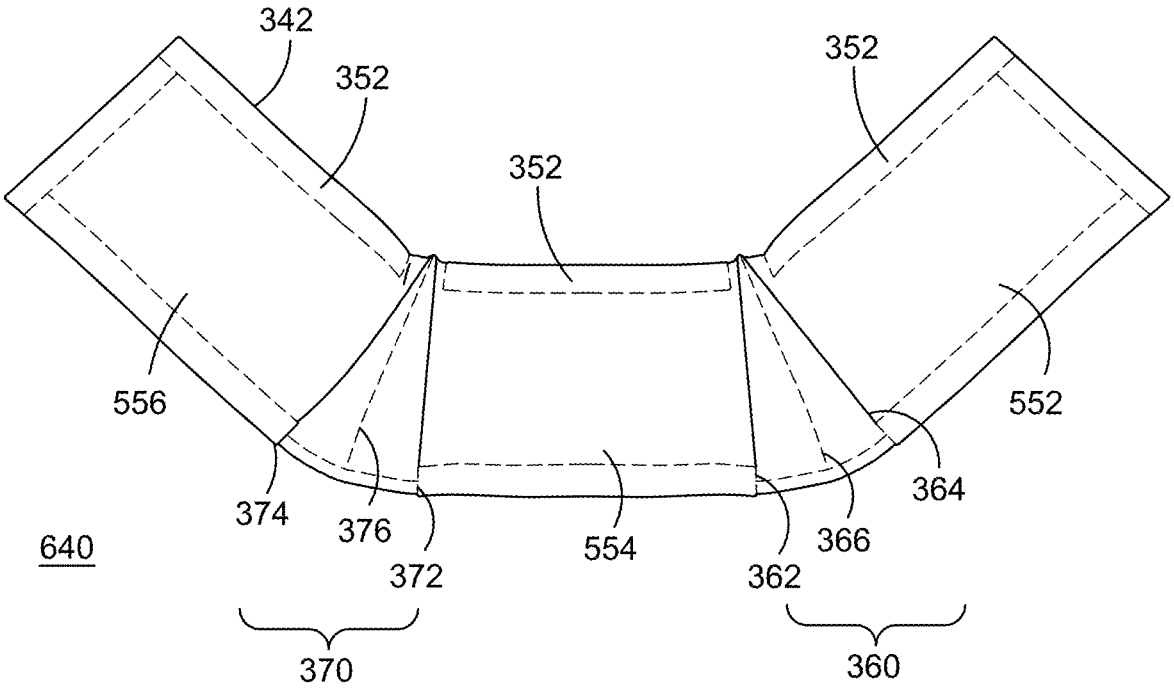
FIG. 10 depicts the inner surface of the side panel of the bed skirt system of FIG. 4 depicts details of the gusset, the fabric grain, and seams, according to one aspect of the present invention.

FIG. 10 depicts the inner surface of the side panel of a bed skirt system of FIG. 4 depicts details of the gusset, the fabric grain, and seams.

Front Panel

Figure 11:
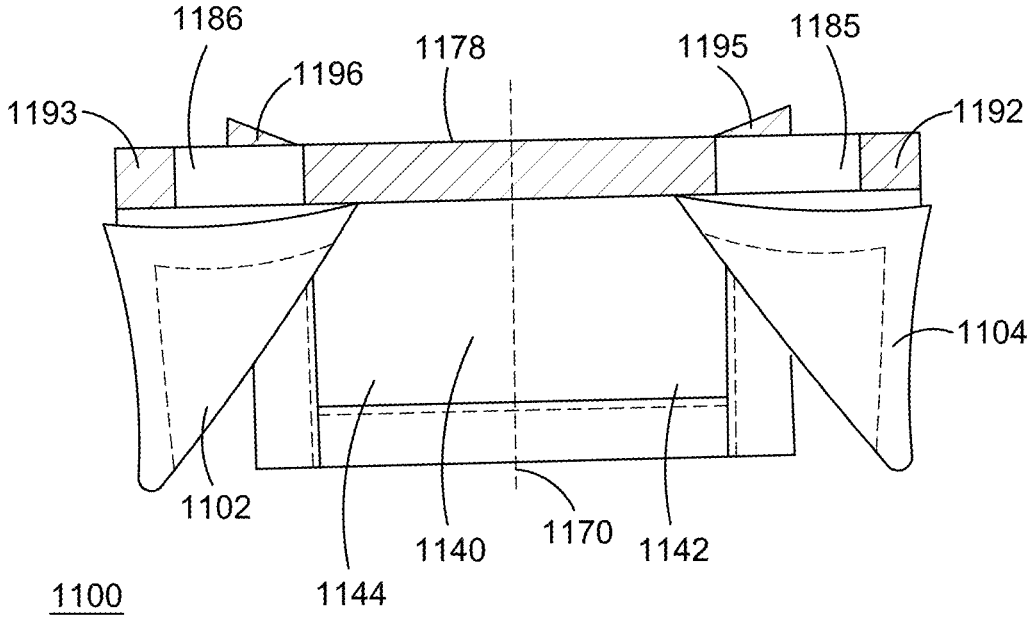
FIG. 11 depicts the inner surface of a front panel of the bed skirt system, according to one aspect of the present invention.

FIG. 11 depicts the inner surface 1170 of a front panel 1100 of the bed skirt system. As further illustrated in FIG. 11 through FIG. 14, the corner foot flaps 1102, 1104 are preferably attached to the front panel 1100 so that a certain width of the outer surface of the flap is detachably contacting the inner surface of the foot panel. In this preferred embodiment, the length of the corner foot flap 1102, 1104 located below the flap's upper perimeter 1185, 1186 is capable of being drawn away from the inner surface 1170 of the front panel 1100, as illustrated in FIG. 11. The inner surface 1170 of the front panel further comprises a section of hook and loop fasteners 1192, 1193 provided along part of the length of the upper perimeter of the front panel and attached corner foot flaps. Preferably, hook and loop fasteners 1192, 1193 are provided at opposing corners of the upper perimeter of each attached corner foot flap, as illustrated in FIG. 11. In another example, the hook and loop fasteners 1192, 1193 are fastened directly on the frame with compatible frame fabric or patent strip system described above in "incorporated references." Note that for a king-size bed using two independently movable twin mattresses, as shown in FIG. 2, the front panel would be in two parts 1142, 1144. There would be a separation down the middle 1170.

Figure 12:
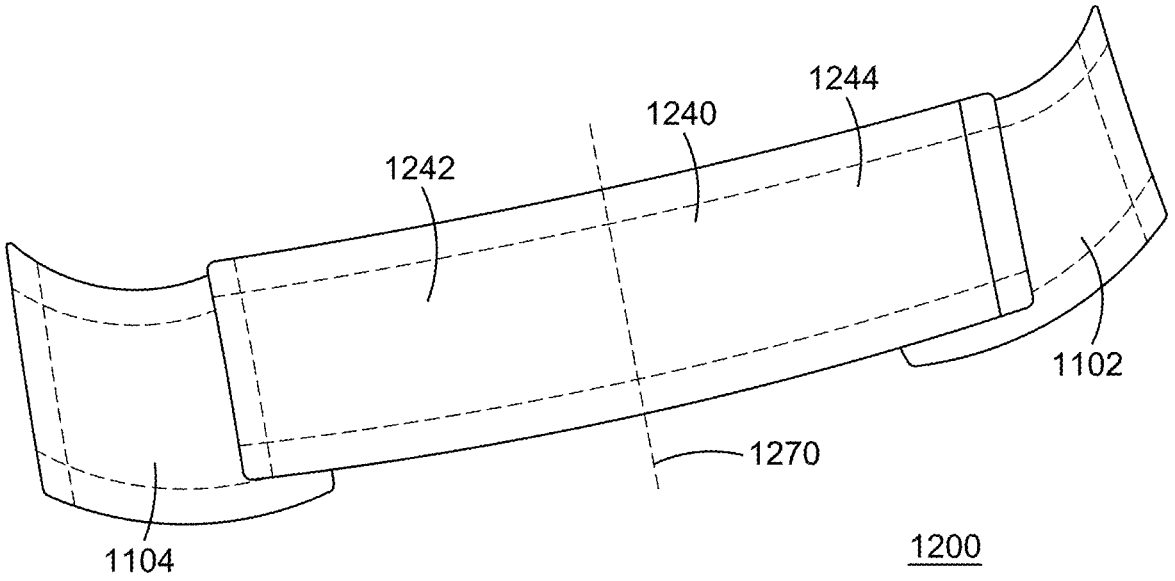
FIG. 12 depicts the outer surface of a front panel of the bed skirt system, according to one aspect of the present invention.

FIG. 12 depicts the outer surface 1240 of the front panel 1100, having two corner foot flaps 1102, 1104 attached at opposing left and right sides of the front panel 1100. As set forth above, the corner foot flaps are preferably attached to the front panel so that a certain width of each corner foot flap remains hidden behind the front panel and a certain width of each corner panel extends beyond the left and right opposing sides of the front panel. Preferably, each side perimeter of the front panel is not secured or attached to the underlying corner foot flap, thereby creating a fold that allows the edge of an adjoining panel to be inserted therein. Further referencing FIG. 12, a preferably squared section of hook and loop fastener 1195, 1196 is provided on the inner surface of the upper perimeter of each folded section of the front panel. As set forth below, fasteners 1195, 1196 can engage and secure to a corresponding fastener provided on the perimeter of an adjacent panel. Note that for a king-size bed using two independently movable twin mattresses, as shown in FIG. 2, the front panel would be in two parts 1242, 1244. There would be a separation down the middle 1270.

Figure 13:
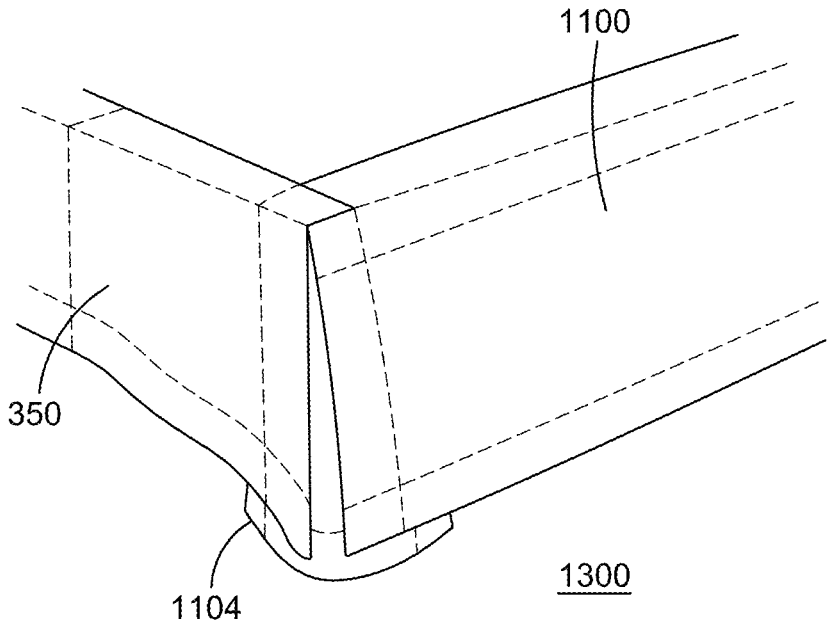
FIG. 13 depicts a front panel of a bed skirt system with attached corner foot flaps being secured to the front perimeter of an adjustable bed frame, according to one aspect of the present invention.
Figure 14:
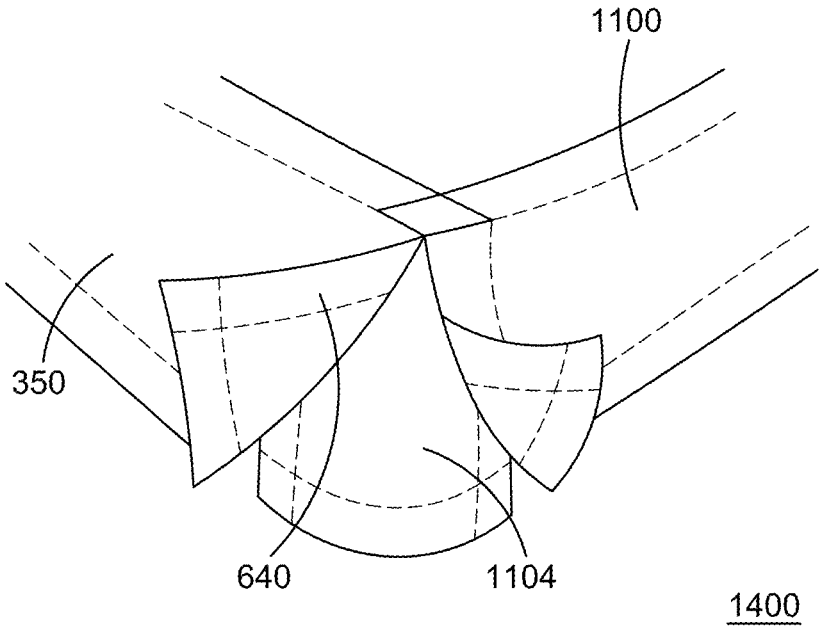
FIG. 14 depicts a mock pleat being formed at the corner of the adjustable bed frame when a side panel of a bed skirt system and the front panel of the bed skirt with attached corner foot flaps are all secured to the perimeter of the bed frame, according to one aspect of the present invention.

Referring to FIGS. 13 and 14, when the side panel 350 and front panel 1100 with attached corner foot flaps 1102, 1104 are all secured to the top perimeter of the box spring, a mock pleat is formed at the corner of the box spring. As illustrated in FIG. 14, after the front panel 1100 with attached corner foot flaps 1102, 1104 is secured to the box spring the side panel 350 is then secured along the length of the box spring's side perimeter. The leading edge 1102 of the side panel 350 is then positioned within the front panel's fold so that the leading edge 1102 of the side panel is positioned between the front panel 1100 and corner foot flap 1102. Preferably, the leading edge 1100 of the side panel 350 is interlocked with the front panel 1100 by engaging and securing the section of fastener provided on the upper perimeter of the side panel's outer surface 356, 358 with the section of fastener 1195, 1196 provided on the upper perimeter of the inner surface of the front panel's fold.

As illustrated in FIG. 13, once the foot panel and side panel are interlocked, a mock pleat is formed whereby the corner foot flap 1102 is visible through a drape line between the respective leading side edges of the side panel 350 and front panel 1100.

Figure 15:
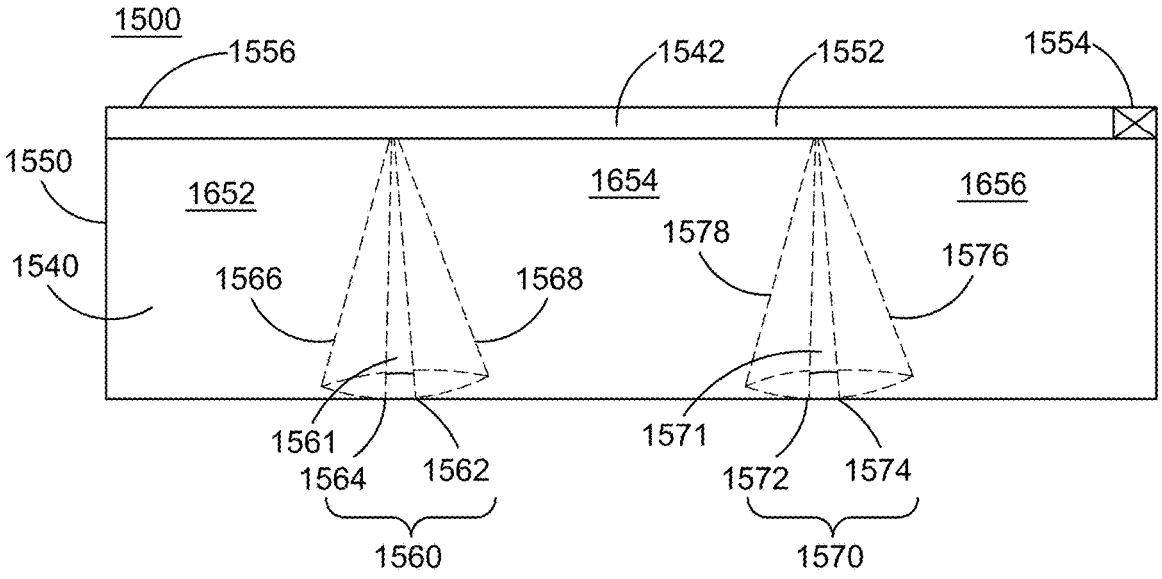
FIG. 15 depicts a view of another embodiment of an outer surface of the side panel of a bed skirt system, which is securable to a top outer edge of a frame of an adjustable bed, according to one aspect of the present invention.

Second Embodiment—Inserts with Two Seams and Two Folds Disposed in a Symmetrical Position FIG. 15 depicts a view of another embodiment 1500 of an outer surface 1540 of a side panel 1550 of a bed skirt system, which is securable to a frame 110 of an adjustable bed 100. There are two gusset inserts 1560 and 1570. Illustrated is the hook and loop system 1552 on the inner surface 1550 near the top 1542 from corner 1556 to corner 1554. In this example, the hook and loop system 1552 can be formed as a separate rectangular piece and attached to the top 1542 as shown. Forming the hook and loop system 1552 as a separate piece minimizes interference or impediment of the opening and closing of the two gusset inserts 1560 and 1570 in response to the bed changing positions.

Notice that the two gusset inserts 1560 and 1570 are disposed in a symmetrical orientation along the side panel 1550. The gusset inserts 1560 and 1570, each with each side on the grain, creating a set of two pleats 1566, 1568, that direct rearward, i.e., away from the outer surface 1540 of side panel 1550. More specifically, gusset insert 1560 includes one side forming a first seam 1562 on the grain of the fabric and the other side forming a second seam 1564 on the grain of the fabric. This creates the set of two folded pleats 1566, 1568.

Likewise, Gusset insert 1570 includes one side forming a first seam 1572 on the grain of the fabric and the other side forming a second seam 1574 on the grain of the fabric. This creates a set of two pleats 1576, 1578 that direct rearward, i.e., away from the outer surface 1540 of side panel 1550 and toward center line 1561, 1571.

Figure 16:
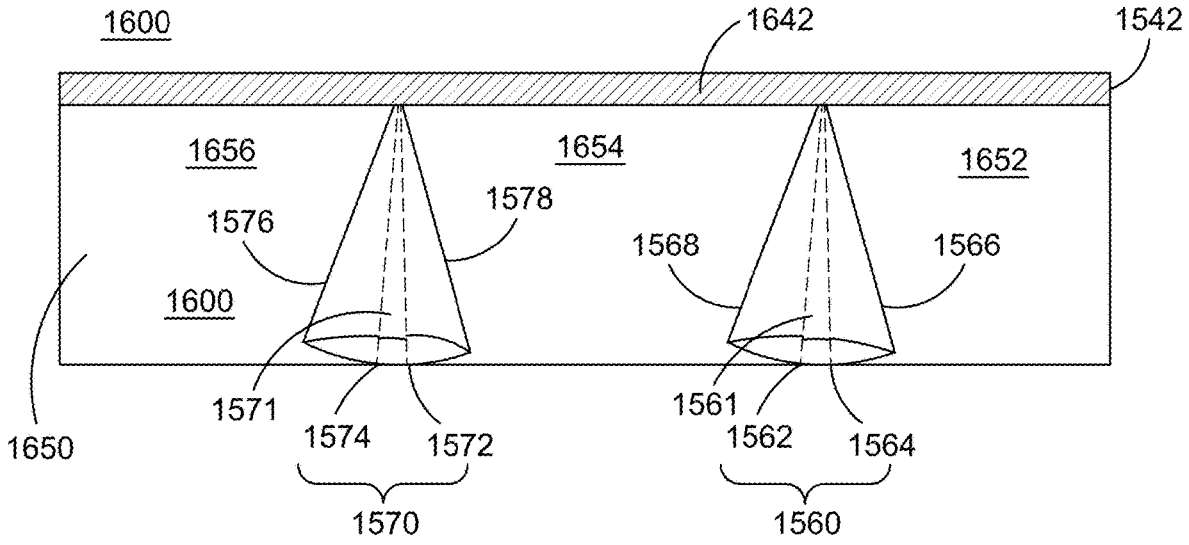
FIG. 16 depicts the inner surface of side panel of FIG. 15 with five major portions, according to one aspect of the present invention.

The set of two pleats 1566, 1568, and 1576, 1578 of the gusset inserts 1560 and 1570 fold behind a stable section 1654 as shown in FIG. 16, towards each other when the bed returns to a flat position. The straight of the grain can also be the center of the triangle at the fold. The direction of the grain on the gusset may change depending on the fabric and weave. This can be described as a gusset inserted with one side on the grain and the other on the bias, creating a pleat that directs towards the bias edge, folding away from the seam.

Generally, cutting a triangular gusset piece with each side on the bias and inserting it between two panels cut on the grain uses the gusset to introduce flexibility and shape while maintaining stability where needed. The grain and bias orientation in the gusset will affect how it performs: The side cut on the grain will provide stability and maintain the structure of the seam. The side cut on the bias offers some stretch, allowing for movement and reducing stress on the seams.

FIG. 16 depicts the inner surface 1650 side panel of FIG. 15 with five major portions. The five major portions are i) movable head 1652, ii) gusset insert 1660, iii) stable portion 1654, iv) gusset insert 1670, and v) movable foot 1656. In one example, the side panel 1650 and front panel 1100 may be constructed at different heights or hem length drop to accommodate different lengths of legs 132 of the adjustable bed 100. The length of the overall side panel is about 80 inches. The approximate length of the five major portions in one example is 26 inches for the movable head 1652, 23 inches for the stable portion 1654, and 31 inches for the movable foot 1656. Of course, other lengths are possible and within the true scope and spirit of the present invention. As described above with reference to FIG. 15, in this example, the hook and loop system 1642 can be formed as a separate rectangular piece and attached to the top 1542 as shown.

Figure 17:
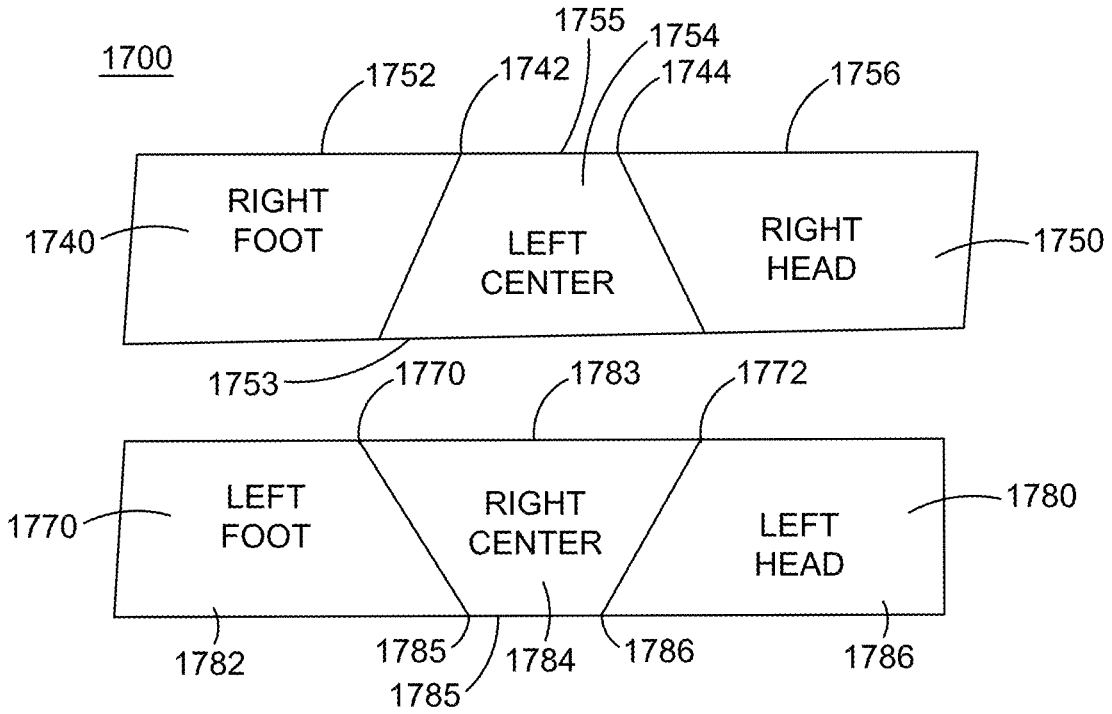
FIG. 17 depicts a view of another embodiment of an outer surface of the side panel of a bed skirt system, which is securable to a top outer edge of a frame of an adjustable bed, according to one aspect of the present invention.

Third Embodiment—Pleats with a Single Seam and Two Folds Disposed in a Symmetrical Position FIG. 17 depicts a view of another embodiment 1700 of an outer surface 1740 of a first side panel 1750 and the outer surface 1770 of the second side panel 1780 of a bed skirt system, which is securable to a frame 110 of an adjustable bed 100. The first side panel 1750 and the second side panel 1780 are cut to form three separate pieces 1752, 1754, 1756, and 1782, 1784, 1786 along lines 1742, 1744, and 1770, 1772 as shown.

Figure 18:
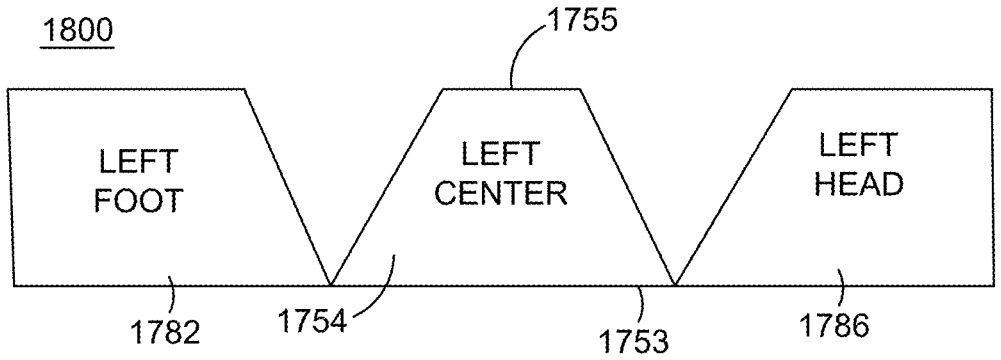
FIG. 18 depicts the side panel of FIG. 17 with the center section rotated 180 degrees, according to one aspect of the present invention.

Focusing only on the second side panel 1780, the process for the other panel would be the same, the center portion 1754 if rotated 180 degrees as shown in FIG. 18. As a result of this rotation, edges 1783 and 1785 of center portion 1754 of FIG. 17 is reoriented, as shown 1800 in FIG. 18.

Figure 19:
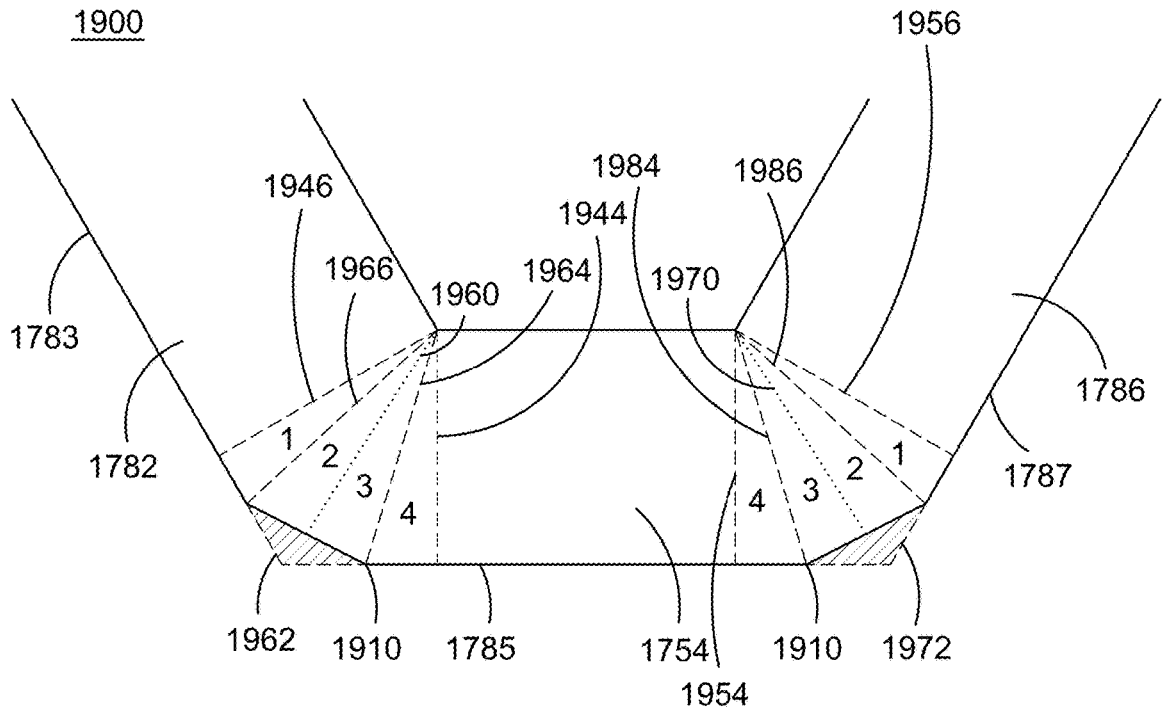
FIG. 19 depicts the side panel of FIG. 18 with the two seams joining three sections together, according to one aspect of the present invention.

FIG. 19 depicts the side panel 1900 of FIG. 18 with the two seams joining three sections together. More specifically, a first seam 1960 joins sections 1782 and 1754, and a second seam 1970 joins sections 1754 and 1786. This is shown in FIG. 19. Note that both the first seam 1960 and second seam 1970 are formed along the bias of sections 1782, 1754, and 1786. Excess material areas 1962 and 1972 will be described with reference to FIG. 20.

Also shown in FIG. 19 is a series of folds. The set of two outer folds 1944, and 1946 forms an outer triangular section as shown. The set of two inner folds 1964, and 1966 forms an inner triangular section around the first seam 1960. Likewise, there are two sets of folds around the second seam 1970. The set of two outer folds 1954, and 1956 forms an outer triangular section as shown around the second seam 1970. The set of two inner folds 1984 and 1986 forms an inner triangular section as shown around the second seam 1970.

Figure 20:
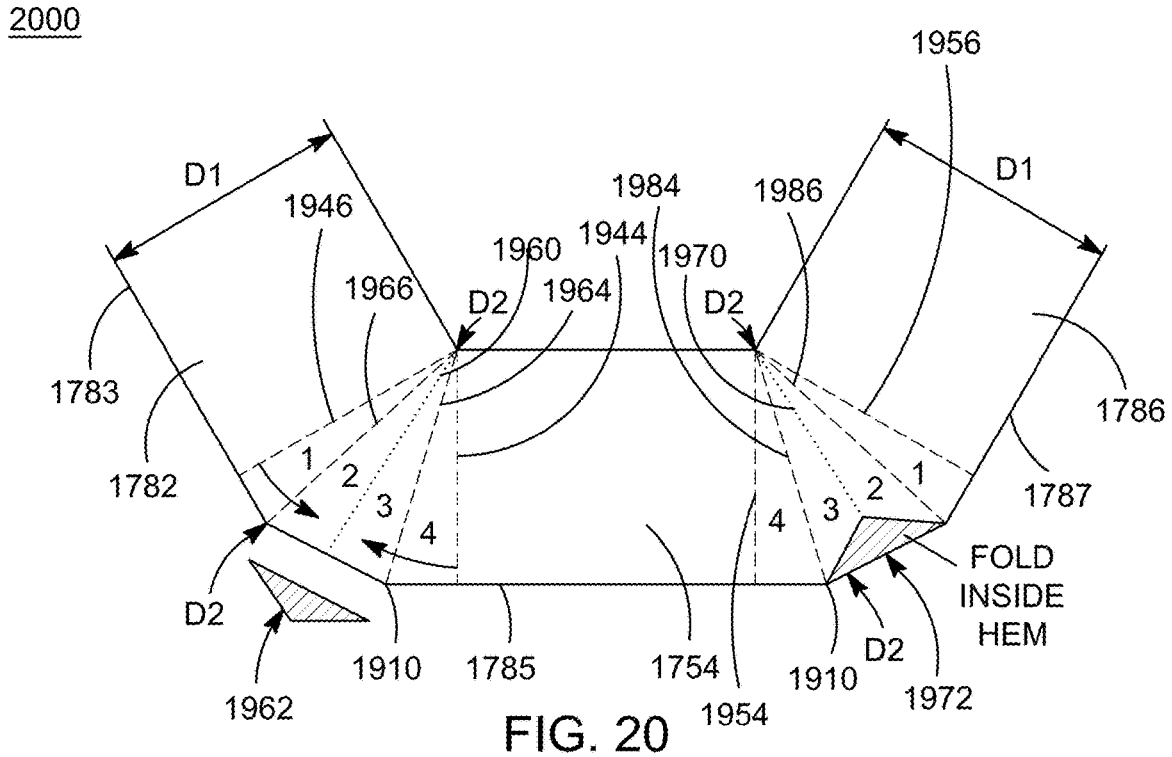
FIG. 20 depicts the side panel of FIG. 19 with the width of side panel adjusted to be constant across all three sections, according to one aspect of the present invention.

FIG. 20 depicts the side panel 2000 of FIG. 19, with the width of the side panel adjusted to be constant across all three sections. Shown is the width D1 of each end of sections 1782 and 1784. However, due to the direction of seam 1960 and 1970, the width D2 must be adjusted by cutting out these areas or by cutting 1962 or folding 1972 the excess material areas to maintain a substantially constant width D1 across all three sections 1782, 1754, and 1786. Note that the excess material areas 1962 and 1972 can form a width that is slightly smaller than D1 and still provide an aesthetically appealing effect when the bed is in a flat position. A hem may be formed by folding up the bottom edge 1910 not shown.

Figure 21:
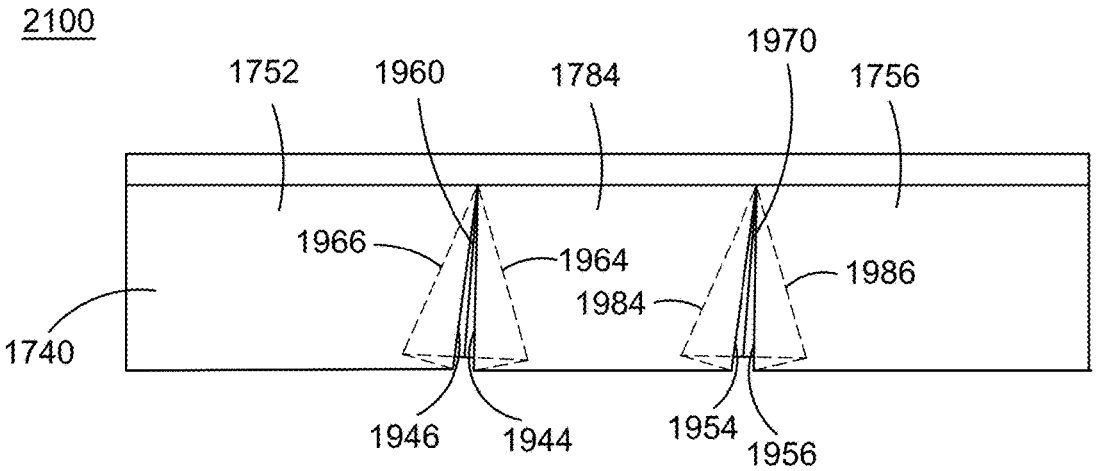
FIG. 21 depicts the side panel of FIG. 20 with the two seams joining three sections together when the bed frame is in a flat position, according to one aspect of the present invention.

FIG. 21 depicts the side panel 2100 of FIG. 20 with the first seam 1960 and second seam 1970 joining three sections 1782, 1754, and 1786 together when the bed frame is in a flat position.

Each set of folds 1944 and 1946, 1954, and 1956 are directed away from the front surface 1770 and symmetrically disposed around a centerline 1960. Likewise, each set of folds 1944 and 1946, 1954 and 1956 are directed away from the front surface 1770 and symmetrically disposed around a centerline 1970 as shown.

Figure 22:
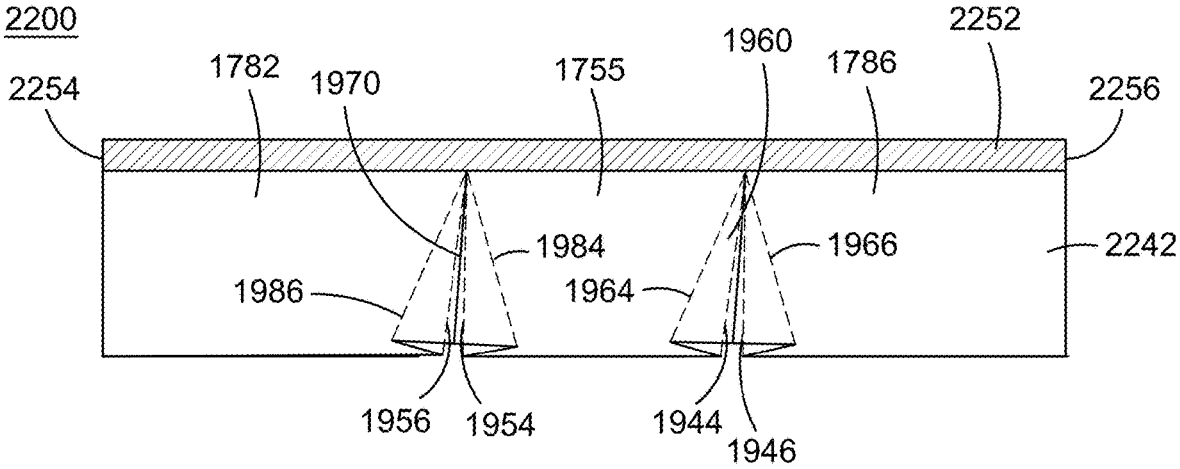
FIG. 22 depicts an inner surface of the side panel of the bed skirt system of FIG. 21, according to one aspect of the present invention.

FIG. 22 depicts an inner surface 2200 of the side panel of the bed skirt system of FIG. 21. An inner surface 1755 of a side panel 1770 of a bed skirt system. Illustrated is the hook and loop system 2252 as an added rectangular band of fabric which is attached near the top 2242 from corner 2254 to corner 2256 as shown.

As noted previously, the direction of the grain on the gusset may change depending on the fabric and weave. The length of the overall side panel is about 80 inches. The approximate length of the five major portions in one example is 26 inches for the movable head 1782, 23 inches for the stable portion 1784, and 31 inches for the movable foot 1786. Of course, other lengths are possible and within the true scope and spirit of the present invention.

NON-LIMITING EXAMPLES

It is to be understood that the above description is intended to be illustrative, and not restrictive. For example, the above-described embodiments (and/or aspects thereof) may be used in combination with each other. In addition, many modifications be made to adapt a particular situation or material to the teachings of the invention out departing from scope. While the dimensions and types of materials described herein are intended to define the parameters of the invention, they are by no means limiting and are exemplary embodiments. Many other embodiments will be apparent to those of skill in the art upon reviewing the above description. The scope of the disclosure is not to be restricted, therefore, to the specific examples, and it is intended that the appended claims cover any and all such applications, modifications, and examples within the scope of the present disclosure.

What is claimed is:

1. A bed skirt for a bed comprising:

a set of rectangular sections including a first rectangular section, a second rectangular section and a third rectangular section, each of the rectangular sections in the set of rectangular sections including a first end, a second end, a top portion, a bottom portion, an outer side and an inner side;

a first triangular-shaped gusset pleat insert formed from a first material with a first grain including a first edge, a second edge, and a bottom circular-arc edge disposed between the second end of the first rectangular section and the first end of the second rectangular section, and at a first distance from the first end of the first rectangular section, a first seam, which is sustainably perpendicular to the top portion of the first rectangular section, the first seam formed across the first grain of the first material to join with the second end of the first rectangular section; and a second seam, which is sustainably perpendicular to the top portion of the second rectangular section, the second seam formed along the first grain of the first material to join with the first end of the second rectangular section; and a second triangular-shaped gusset pleat insert formed from a second material with a second grain including a first edge, a second edge, and a bottom circular-arc edge disposed between the second end of the third rectangular section and the second end of the second rectangular section, and at a second distance from the first end of the first rectangular section, a first seam, which is sustainably perpendicular to the top portion of the second rectangular section, the first seam formed along the second grain of the second material to join with the second end of the second rectangular section; and a second seam, which is sustainably perpendicular to the top portion of the third rectangular section, the second seam formed across the second grain of the second material to join with the first end of the third rectangular section; and a strip of one of i) a hook fastener, ii) a loop fastener or iii) both, attached along the top portion of an inner side of the top portion of the set of rectangular sections.

2. The bed skirt of claim 1, wherein the first rectangular section is joined together with the second rectangular section by the first triangular-shaped gusset pleat insert and the second rectangular section is joined together with the third rectangular section by the second triangular-shaped gusset pleat insert forms one of a substantially u-shape or substantially parabolic shape.

3. The bed skirt of claim 1, wherein the first triangular-shaped gusset pleat insert and the second triangular-shaped gusset pleat insert further comprises a fold between the first edge and the second edge, wherein the fold protrudes away the outer side toward the inner side.

4. The bed skirt of claim 1, wherein the first triangular-shaped gusset pleat insert and the second triangular-shaped gusset pleat insert further comprises a plurality of folds between the first edge and the second edge, wherein the plurality of folds protrudes away the outer side toward the inner side.

5. The bed skirt of claim 1, further comprising:

a bed frame with a right side, a left side, a head area and a foot area;

a strip of one of i) a hook fastener, ii) a loop fastener or iii) both, attached along a one of i) a right side top portion, a left side top portion, or ii both of the bed frame to correspondingly attach and secure to the strip attached of the set of rectangular sections.

6. A system for securing a bed skirt to an adjustable bed frame with a right side, a left side, a head area and a foot area, with a first hinge disposed at a first distance from a head of the adjustable bed frame and a second hinge disposed at a second distance from the head of the adjustable bed frame to allow independent adjustment of various sections of lying surface, the system comprising:

a pair of u-shaped side bed skirt panels form from a material with a grain, each of the u-shaped side bed skirt side panels includes a first rectangular portion, a second rectangular portion, and a third rectangular portion;

a top portion, a front outer side panel, a back inner side panel, and a bottom portion, an upper strip of one of i) hook fastener, ii) loop fastener, or both disposed on a back inner side near the top portion;

a first triangular-shaped gusset pleat insert with a first edge, a second edge, and a bottom circular-arc edge disposed between and joining together the first rectangular portion and the second rectangular portion at the first distance from the head area of the adjustable bed frame, the first triangular-shaped gusset pleat insert including the first edge with a first seam formed across the grain of a fabric which is sustainably perpendicular to the top portion nearest the head area of the adjustable bed frame, and the second edge with a second seam formed along the grain of the fabric which is sustainably perpendicular to the top portion; and a second triangular-shaped gusset pleat insert with a first edge, a second edge, and a bottom circular-arc edge disposed between and joining together the second rectangular portion and the third rectangular portion at the second distance from the head area of the adjustable bed frame, the second triangular gusset pleat including the first edge with a third seam formed along a grain of the fabric which is sustainably perpendicular to the top portion nearest the foot area of the adjustable bed frame, and the second edge with a fourth seam formed across the grain which is sustainably perpendicular to the top portion;

a strip of one of i) a hook fastener, ii) a loop fastener or iii) both, attached along the top portion of the first rectangular portion, the second rectangular portion, and the third rectangular portion.

7. The bed skirt of claim 6, wherein the first rectangular portion is joined together with the second rectangular portion by the first triangular-shaped gusset pleat insert and the second rectangular portion is joined together with the third rectangular portion by the second triangular-shaped gusset pleat insert forms one of a substantially u-shape or substantially parabolic shape.

8. The bed skirt of claim 6, wherein the first triangular-shaped gusset pleat insert and the second triangular-shaped gusset pleat insert further comprises a fold between the first edge and the second edge, wherein the fold protrudes away an outer side toward an inner side.

9. The bed skirt of claim 6, wherein the first triangular-shaped gusset pleat insert and the second triangular-shaped gusset pleat insert further comprises a plurality of folds between the first edge and the second edge, wherein the plurality of folds protrudes away an outer side toward an inner side.

10. The bed skirt of claim 6, further comprising:

a bed frame with a right side, a left side, a head area and a foot area;

a strip of one of i) a hook fastener, ii) a loop fastener or iii) both, attached along a one of i) a right side top portion, a left side top portion, or ii both of the bed frame to correspondingly attach and secure to the strip attached of the top portion of the first rectangular portion, the second rectangular portion, and the third rectangular portion.

11. A system for securing a bed skirt to an adjustable bed frame with a right side, a left side, a head area and a foot area, with a first hinge disposed at a first distance from a head of the adjustable bed frame and a second hinge disposed at a second distance from the head of the adjustable bed frame to allow independent adjustment of various sections of lying surface, the system comprising:

a pair of three piece rectangular sections defining a head section, a middle section and a foot section, the three piece rectangular sections formed by cutting a trapezium shaped piece from one rectangular piece of material with a height and width, each of the head section, the middle section and the foot section including a first end, a second end, a top, a bottom, an outer side and an inner side, the trapezium shaped piece is rotated 180 degrees so that its bottom aligns with the top of the head section and the foot section, a first seam formed between the head section and the middle section and at a first distance from the first end of the head section and a second seam form between the middle section and the foot section at a second distance from the first end of the head section, a first set of hems formed into a left hand triangular shape and a right hand triangular shape disposed in a mirror position at the bottom of the first seam and a second set of hems formed into a left hand triangular shape and a right hand triangular shape disposed in a mirror position at the bottom of the second seam so that the width of the first end of the head section is greater than or equal to a width at the first seam and a width at the second seam; and a strip of one of i) a hook fastener, ii) a loop fastener or iii) both, attached along the top of the head section, the middle section and the foot section.

12. The bed skirt of claim 11, wherein the head section, the middle section and the foot section forms one of a substantially u-shape or substantially parabolic shape.

13. The bed skirt of claim 11, wherein the head section, the middle section and the foot section further comprises a first fold between the first end of the head section and the first seam, a second fold between the first seam and the middle section, a third fold between the middle section and the second seam, and a fourth fold between the second seam and the foot section, wherein each of the first fold, the second fold, the third fold and the fourth fold protrudes away the outer side toward the inner side.

14. The bed skirt of claim 11, further comprising:

a bed frame with a right side, a left side, a head area and a foot area;

a strip of one of i) a hook fastener, ii) a loop fastener or iii) both, attached along a one of i) a right side top portion, a left side top portion, or ii both of the bed frame to correspondingly attach and secure to the strip attached of the top of the head section, the top of the middle section and the top of the foot section.

* * * * *